US007391287B2

(12) United States Patent
Tong et al.

(10) Patent No.: US 7,391,287 B2
(45) Date of Patent: Jun. 24, 2008

(54) BANDPASS FILTER WITH PSEUDO-ELLIPTIC RESPONSE

(75) Inventors: Dominique Lo Hine Tong, Rennes (FR); Charline Guguen, Rennes (FR); Walid Karoui, Toulouse (FR)

(73) Assignee: Thomson Licensing, Boulogne-Billancourt (FR)

( * ) Notice: Subject to any disclaimer, the term of this patent is extended or adjusted under 35 U.S.C. 154(b) by 179 days.

(21) Appl. No.: 10/537,701

(22) PCT Filed: Nov. 26, 2003

(86) PCT No.: PCT/EP03/50899

§ 371 (c)(1),
(2), (4) Date: Jun. 6, 2005

(87) PCT Pub. No.: WO2004/054031

PCT Pub. Date: Jun. 24, 2004

(65) Prior Publication Data

US 2006/0066421 A1 Mar. 30, 2006

(30) Foreign Application Priority Data

Dec. 9, 2002 (FR) ..... 02 15617

(51) Int. Cl.
*H01P 1/20* (2006.01)

(52) U.S. Cl. ..... 333/208

(58) Field of Classification Search ..... 333/208, 333/209, 210
See application file for complete search history.

(56) References Cited

U.S. PATENT DOCUMENTS 3,582,536 A * 6/1971 Miller ..... 174/102 D
4,278,933 A * 7/1981 Klopach et al. ..... 324/627
4,453,146 A * 6/1984 Fiedziuszko ..... 333/212

FOREIGN PATENT DOCUMENTS

EP 401995 12/1990
EP 729197 8/1996

OTHER PUBLICATIONS

H. Schmiedel et al., "Low-Cost Waveguide Filters With Printed-Circuit Inserts", Institute of Electrical and Electronics Engineers, 1996 IEEE MTT-S Int'l Microwave Symposium Digest. San Francisco, Jun. 17-21, 1996, New York, vol. 2, Jun. 17, 1996, pp. 611-614. Search Report dated Mar. 31, 2004.

* cited by examiner

*Primary Examiner*—Robert J. Pascal
*Assistant Examiner*—Kimberly E Glenn
(74) *Attorney, Agent, or Firm*—Joseph J. Laks; Robert D. Shedd; Brian J. Cromarty

(57) ABSTRACT

The invention proposes an H-plane filter with inductive irises which exhibits a quasi-elliptic response while retaining the same compactness as a filter having a Chebyshev response. The invention furthermore makes it possible to use a large number of transmission zeros. For this purpose, there is proposed a waveguide filter comprising at least one cavity delimited by at least two inductive irises. The filter furthermore comprises at least one floating insert 1 placed in one of the inductive irises. The invention is also a process for manufacturing the waveguide filter incorporating at least one insert.

8 Claims, 5 Drawing Sheets

BANDPASS FILTER WITH PSEUDO-ELLIPTIC RESPONSE

This application claims the benefit, under 35 U.S.C. § 365 of International Application PCT/EP03/50899, filed Nov. 26, 2003, which was published in accordance with PCT Article 21(2) on Jun. 24, 2004 in English and which claims the benefit of French patent application No. 0215617, filed Dec. 9, 2002.

BACKGROUND OF THE INVENTION

1. Field of the Invention

The invention pertains to a bandpass filter with pseudo-elliptic response of waveguide type. Such a filter is used in particular in high-frequency transmission systems.

2. Description of the Prior Art

The mass-market development of broadband bidirectional transmission devices requires the use of a filtering device exhibiting considerable constraints in terms of selectivity, bandwidth, bulkiness and cost. These constraints are very considerable at the level of the filtering carried out on the antenna side to isolate transmission and reception where signals lying in two very close bands have to be isolated from one another.

Among the filtering technologies usable for millimeter frequencies, the technologies of waveguide type exhibit a quality factor high enough to meet the requirements. The waveguide filters most commonly used are nowadays E-plane filters with dielectric insert and H-plane filters with inductive irises.

Beyond 40 GHz, and for highly selective filters, it is preferable to use H-plane filters with inductive irises. FIG. 1 represents a bandpass filter of order 3 with four inductive irises possessing a Chebyshev type response. Such a filter, in order to be highly selective, has to have a high order N, giving rise to an increase in the number of irises which is equal to N+1. However, the increase in the number of irises causes an increase in the size of the filter.

In order to increase the selectivity of an iris filter, it is known, for example, from the article by W. MENZEL et al, "Planar integrated waveguide diplexer for low cost millimeter-wave applications" EUMC, pp 676-680, September 1997, to introduce transmission zeros near the passband. The introduction of transmission zeros produces a quasi-elliptic response which improves the selectivity of the filter. On the other hand, the introduction of transmission zeros is achieved by adding sections of guide (or resonant cavities) placed perpendicularly to the principal axis of the filter, therefore rendering the filter less compact. Furthermore, the number and the frequency positioning of the transmission zeros is limited on account of the method of implementation.

An aim of the invention is to propose an H-plane filter with inductive irises which exhibits a quasi-elliptic response while retaining the same compactness as a filter having a Chebyshev response. A second aim is to be able to use a large number of transmission zeros. For this purpose, there is proposed a waveguide filter with inductive iris in which at least one floating insert is placed in an iris.

SUMMARY OF THE INVENTION

The invention is a waveguide filter comprising at least one cavity delimited by at least two inductive irises. The filter furthermore comprises at least one floating insert placed in one of the inductive irises.

The expression floating insert should be understood to mean a metal insert that is not electrically linked to the waveguide so that its potential is floating as a function of the electromagnetic field circulating in the waveguide.

According to various preferred embodiments, the floating insert is placed nearer to the edge of the iris than to the centre of the iris. The filter comprises at least one block of dielectric foam inside the waveguide. The floating insert is printed on the block of foam. The foam has a relative dielectric constant of close to 1.

The invention is also a process for manufacturing a waveguide filter in which a waveguide is made in two parts, the waveguide comprising at least one cavity delimited by two irises. Before assembling the two parts of the waveguide, at least one block of dielectric foam is placed inside the waveguide. The block supports at least one metallization which forms at least one floating insert.

Preferably, the insert is made by a technique of printing on the foam.

BRIEF DESCRIPTION OF THE DRAWINGS

The invention will be better understood, and other features and advantages will become apparent on reading the description which follows, the description making reference to the appended drawings in which.

Figure 2A:
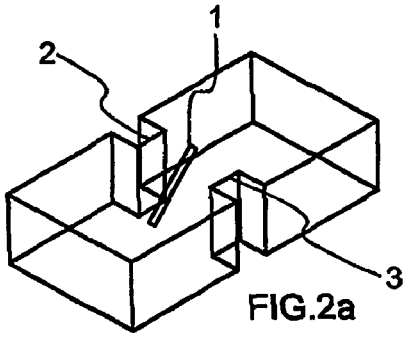
FIG. 2*a* represents a metal insert 1 placed in an iris delimited by two shims 2 and 3. The metal insert 1 is placed in a floating manner, that is to say it does not touch any edge of the waveguide so as to be able to resonate at a frequency which depends on its length and on the coupling with the electric field. The coupling with the electric field depends among other things on the position of the insert with respect to the centre of the waveguide and the inclination of the insert with respect to the axis of the guide. There is at present no computational model for determining the resonant frequency of an insert placed in an iris.
Figure 2B:
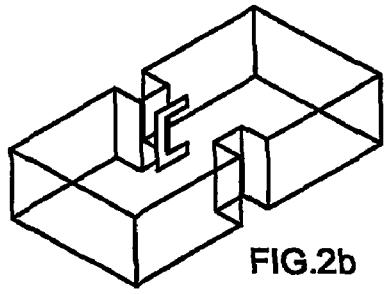
FIG. 2 represents various possibilities of embodiment of a floating insert in an iris.
Figure 2C:
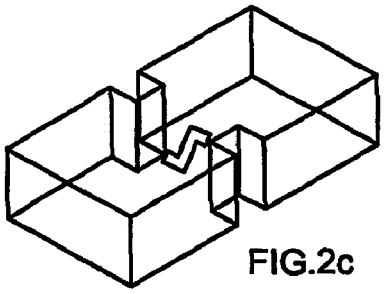
Figure 2D:
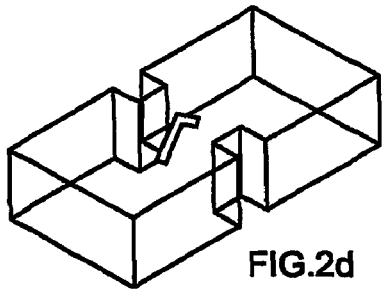

The method used for dimensioning the insert consists in starting from an insert length equal to $\lambda_r/2$, with $\lambda_r$ the wavelength corresponding to the desired resonant frequency. Then, with the aid of an electromagnetic simulator, the resonant frequency is evaluated and then the size of the insert is modified as are possibly its inclination and its position in the iris as a function of the result of the simulation performed. The length of the insert is obtained after a few simulations and may be further refined with the aid of prototype. If the length of the insert is too considerable it is always possible to bend the insert to obtain a C insert (FIG. 2*b*), an S insert (FIG. 2*c*) or an L insert (FIG. 2*d*).

The presence of an insert in a waveguide has the effect of creating a transmission zero for its resonant frequency. The insert transforms a simple guide into a highly selective bandstop filter. A drawback is that the insert interacts with the waveguide and produces additional disturbances. Placed in a filter, the characteristic of the filter is modified by the presence of the insert.

Figure 3:
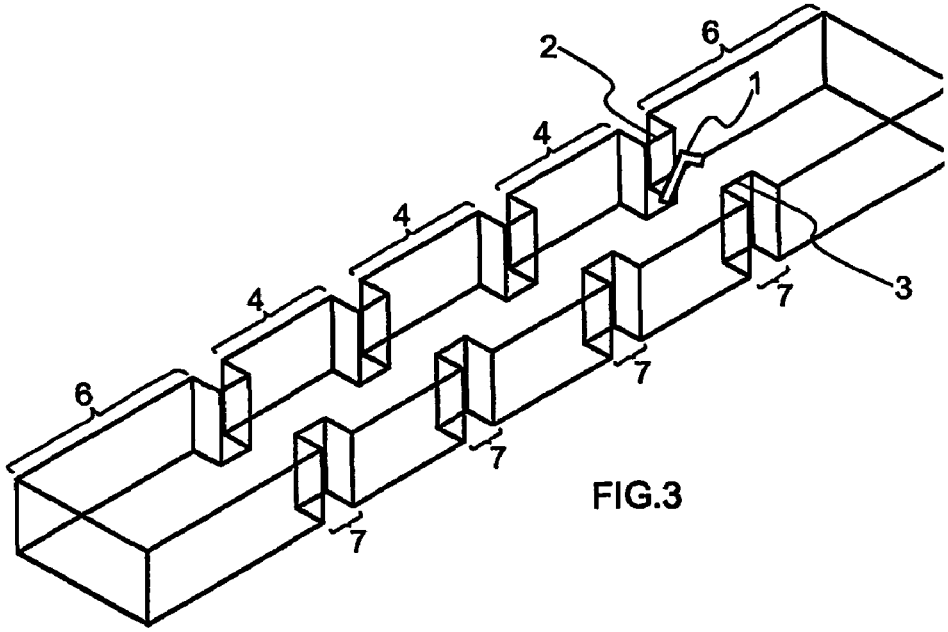
FIG. 3 represents an exemplary embodiment of a waveguide filter furnished with a floating insert.

FIG. 3 represents, in perspective, a filter furnished with three mutually coupled cavities 4 and with two access paths 6 by way of four irises 7. The filter of FIG. 3 comprises a floating insert 1 placed in an iris. The filter of FIG. 3 is a filter of the type represented in FIG. 1 so as to have one and the same passband. The floating insert is determined in such a way that its resonant frequency is placed outside the passband so as to strengthen the rejection of the filter at the band boundary. The transmission zero being placed at a location where the slope of the filter has to be greatly increased.

In order not to overly disturb the field inside the filter and hence the characteristic of the insertless filter, the insert is preferably placed in proximity to a shim 2. It is possible to place the insert at the centre of the guide, that is to say just where the coefficient of coupling with the field is a maximum, but the filter has to be redimensioned accordingly to retain the same passband since too considerable a coupling has the effect of greatly modifying the characteristic of the filter and in particular its passband.

Figure 1:
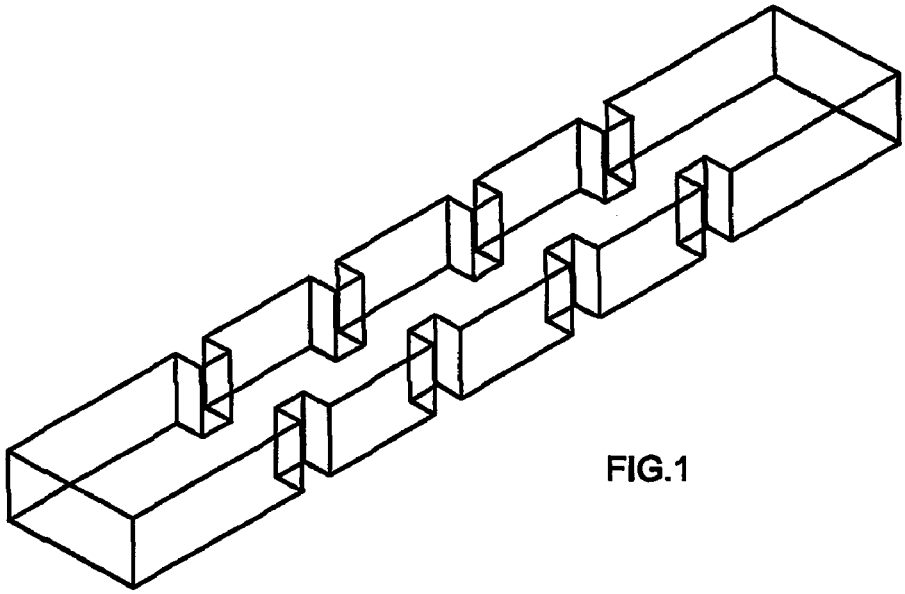
FIG. 1 represents an iris waveguide filter according to the state of the art.
Figure 4:
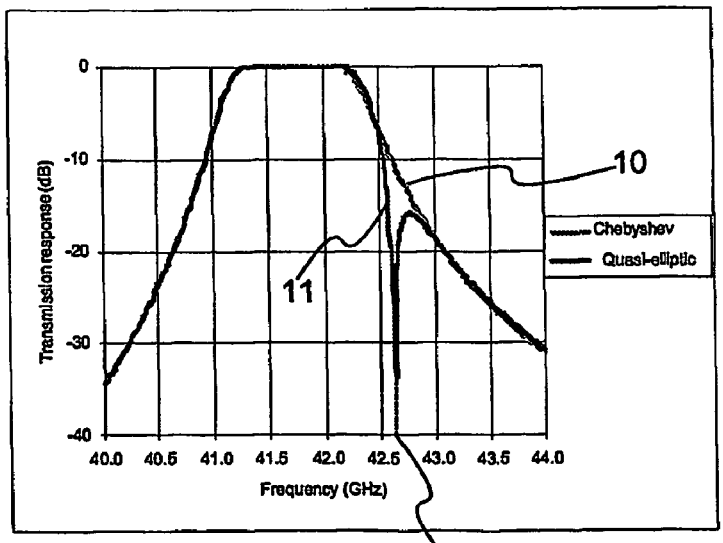
FIG. 4 represents an exemplary frequency response of the filter of FIG. 3, FIGS. 5 and 6 represent two exemplary embodiments of waveguide filters with two inserts, according to the invention.

FIG. 4 shows a possible exemplary response of the filter of FIG. 3 in comparison with the filter of FIG. 1. The curve 10 corresponds to the filter of FIG. 1 which has a Chebyshev type frequency response. The curve 11 corresponds to the response of the filter of FIG. 3 in the case of an insert resonating at the frequency 12. The curve 11 corresponds to a pseudo-elliptic type response which exhibits a higher degree of rejection at the passband upper boundary than a Chebyshev type response. The passband of the filter remains the same.

Figure 5:
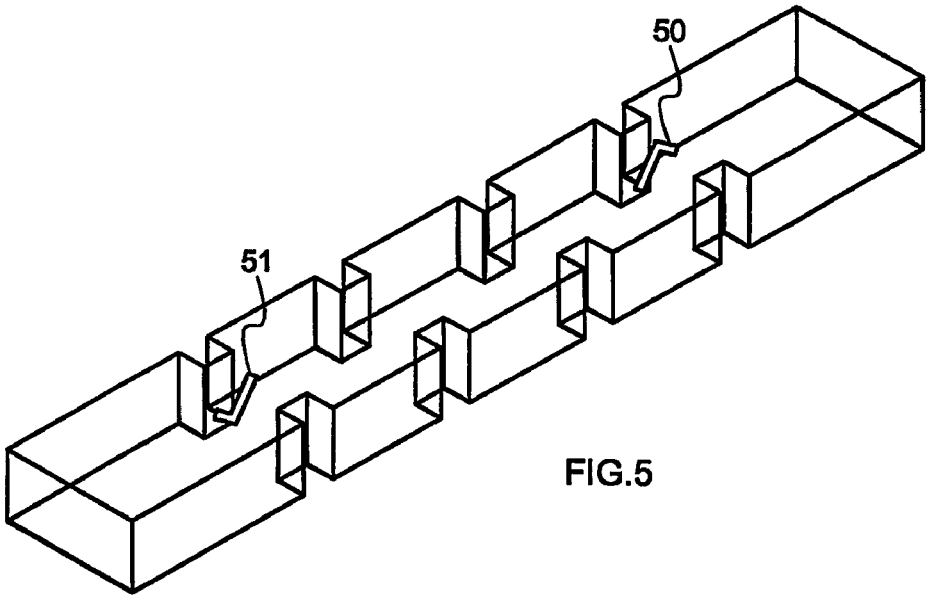
Figure 6:
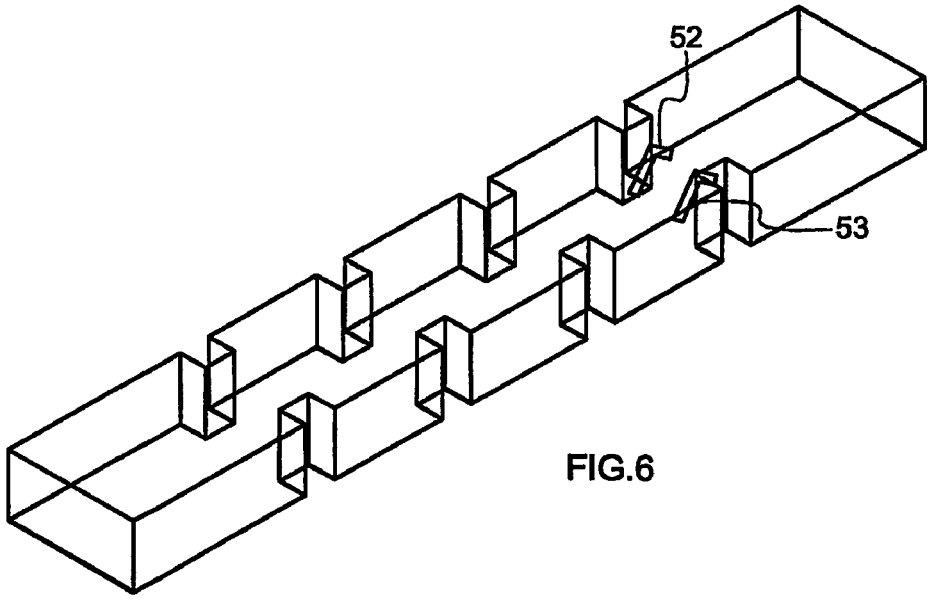

Of course, the addition of an insert may not be sufficient. Preferably, several inserts are added. FIG. 5 shows a filter with two inserts 50 and 51 placed in two different irises. FIG. 6 shows a filter with two inserts 52 and 53 placed in the same iris. It is entirely possible to place one, two or more inserts in each iris, in the case of a filter furnished with four irises, up to eight inserts can be placed, thereby making it possible to add eight transmission zeros and hence to appreciably strengthen the effect produced at the level of the edges of the response of the filter.

When several inserts are used, the size of each insert should be determined individually. Then a simulation of the filter is performed, incorporating all the inserts so as to refine the size of the inserts and possibly redimension the shims of the irises.

Figure 7:
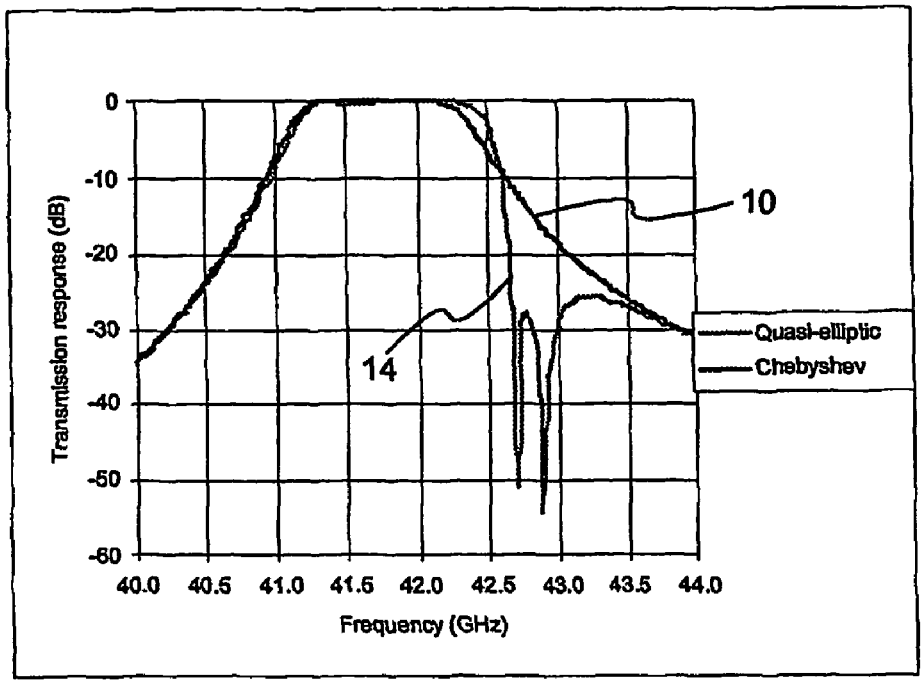
FIGS. 7 and 8 represent two exemplary frequency responses of the filters of FIGS. 5 and 6.

FIG. 7 shows a response curve 14 of a filter corresponding to FIG. 5 or 6 or for which the resonant frequencies of the inserts are placed on one and the same side of the passband. Relative to the curve 11, the person skilled in the art may note that the effect produced by the two inserts on the curve 14 corresponds to an amplified effect.

Figure 8:
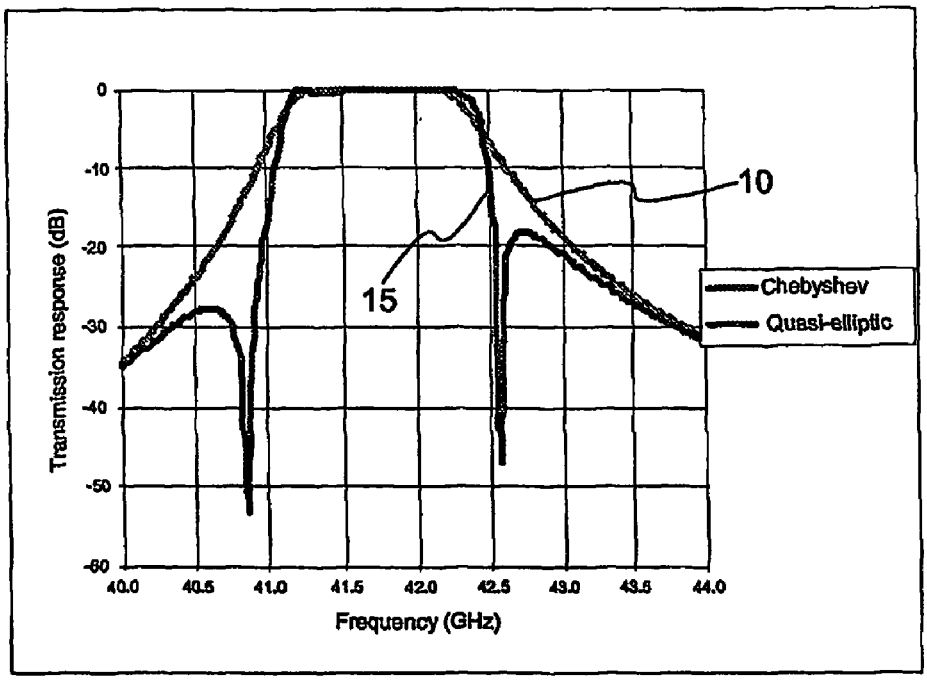

FIG. 8 shows a response curve 15 of a filter corresponding to FIGS. 5 and 6 and for which the resonant frequencies of the inserts are placed on each side of the passband. Obviously, If one wishes to increase the rejection edges on each side of the band, it is possible to resort to a more considerable number of inserts.

The person skilled in the art may note that the bulkiness of a filter according to the invention remains unchanged relative to a filter with no transmission zero. Also, the number of transmission zero may be equal to M*(N+1), with M the number of insert per iris and N the order of the iris filter, without thereby changing the bulkiness of the filter.

Figure 9:
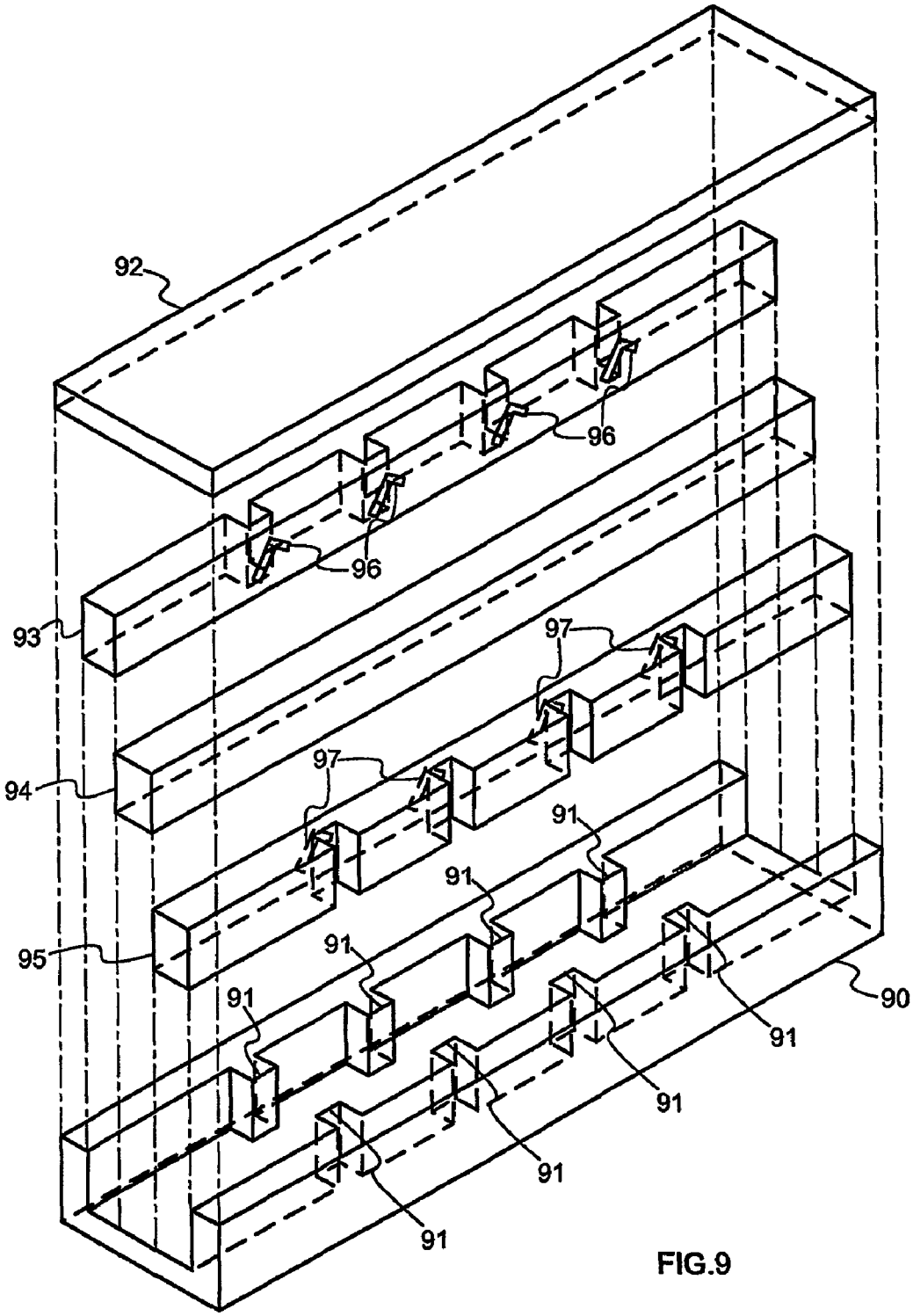
FIG. 9 illustrates a mode of manufacturing a filter according to the invention.

As far as the making of such a filter is concerned, numerous techniques are possible. The technique described hereinbelow with the aid of FIG. 9 enables such a filter to be made at lesser cost.

A conducting block 90 is moulded and/or machined in order to correspond to a waveguide fitted with shims 91 forming irises. A conducting lid 92 serves to close the block 90 thus forming a waveguide filter. First, second and third blocks of foam 93 to 95 are placed in the waveguide before closing the lid 92. The blocks of foam 93 to 95 are made for example from polymethacrylate foam, sold under the trademark ROHACELL HF, and which is for example moulded by thermo-compression. In a general manner, the foam used should have a relative dielectric constant $\epsilon_r$ of close to 1, low losses, for example of the order of $10^{-4}$, and on which it is possible to make a metallization. The first and the third blocks of foam 93 to 95 also serve as substrate for the metal inserts 96 and 97. The inserts 96 and 97 are made with the aid of a technique compatible with the foam chosen. The metallization is for example a deposition of conducting paint done through a mask on which the patterns to be implanted have previously been inscribed. The paint is for example of silver type and should exhibit sufficient mechanical grab to remain on the foam.

Preferably, the entire waveguide is filled with foam so as to obtain a homogeneous propagation medium. However, it is possible not to fill the entire guide with foam if the behaviour of the foam is much like air. It Is possible to use for example a single block of foam supporting the inserts, the block being stuck on a side or in the middle of the guide.

Obviously, numerous variants of the invention are possible. The number of cavity of the filter may vary as a function of the requirements of the person skilled in the art. Numerous types of foam may be used. The choice of conducting paints is relatively wide. The inserts may be made according to a printing technique other than painting, for example by photolithography of a metal layer integral with the foam.

The invention claimed is:

1. Waveguide filter comprising at least one cavity delimited by at least two inductive irises, wherein the filter furthermore comprises at least a block of foam placed inside the waveguide and supporting at least one metallization which forms at least one floating insert placed in one of the inductive irises.

2. Filter according to claim 1, wherein the at least one floating insert is placed nearer to the edge of the iris than to the centre of the iris.

3. Filter according to claim 2, wherein the at least one floating insert is printed on the block of foam.

4. Filter according to claim 2, wherein the foam has a relative dielectric constant of close to 1.

5. Filter according to claim 4, wherein the foam is a polymethacrylate foam.

6. Filter according to claim 2, wherein the at least a floating insert is painted on the block of foam.

7. Process for manufacturing a waveguide filter in which a waveguide is made in two parts, the waveguide comprising at least one cavity delimited by two irises, wherein before assembling the two parts of the waveguide, at least one block of dielectric foam is placed inside the waveguide, and in that the block supports at least one metallization which forms at least one floating insert placed in one of the inductive irises.

8. Process according to claim 7, wherein the at least one insert is made by a technique of printing on the foam.

* * * * *